US005323897A

United States Patent [19]

Sperber

[11] Patent Number: 5,323,897

[45] Date of Patent: Jun. 28, 1994

[54] PORTABLE ENCLOSURE - SELF-CONTAINED FOR WET ARTICLES

[76] Inventor: Donald S. Sperber, 954 Woodgrove Dr., Cardiff by the Sea, Calif. 92007

[21] Appl. No.: 939,157

[22] Filed: Sep. 2, 1992

[51] Int. Cl.[5] ..... B65D 85/18

[52] U.S. Cl. ..... 206/287; 34/622; 206/289; 223/51; 383/103; 383/117

[58] Field of Search ..... 206/278, 286, 287, 287.1, 206/289; 34/90, 151; 383/103, 117; 223/51

[56] References Cited

U.S. PATENT DOCUMENTS

| | | | |
|---|---|---|---|
| 2,561,841 | 7/1951 | Cart | 206/287 X |
| 2,596,412 | 5/1952 | Kish, Jr. et al. | 206/287.1 X |
| 2,975,529 | 3/1961 | Weber | 206/287 X |
| 3,264,755 | 8/1966 | Moore | 206/287 X |
| 3,335,826 | 8/1967 | Swirles | 206/287.1 |
| 3,432,939 | 3/1969 | Eichholz | 34/151 |
| 3,601,292 | 8/1971 | Bliss | 34/151 X |
| 3,752,373 | 8/1973 | Smith | 223/51 |
| 4,887,700 | 12/1989 | Rice | 206/287.1 X |
| 4,949,842 | 8/1990 | Mokiao, II | 206/286 |

*Primary Examiner*—Bryon P. Gehman

[57] ABSTRACT

A portable enclosure for the placement of wet articles for storage and at least partial drying. The enclosure includes a rigid plastic frame including an article hanger enclosed by a housing with a top, bottom and sides. At least three of the sides and the top are at least partially formed of a mesh material and at least the bottom is impervious. An exteriorly extending adjustable length strap with Velcro type closure means attached to the frame can be looped over an external support to support the enclosure and contents. A container is located in the bottom of the housing to catch any liquid dripping from the wet articles to contain the dripping within the housing. A zippered opening in one wall is provided for selected entry into the interior of the housing.

6 Claims, 2 Drawing Sheets

PORTABLE ENCLOSURE - SELF-CONTAINED FOR WET ARTICLES

BACKGROUND

1. Field of Invention

This invention relates to a portable enclosure, self-contained to allow placement of wet articles so that they may drain and dry within.

2. Description of Prior Art

I myself and everyone that I have talked to about the field of invention know of nothing of its kind.

SUMMARY OF THE INVENTION

It was mainly designed to hold a wetsuit or other wet items to drain and dry out, when in an area that is not possible to do so normally, such as a vehicle, office or etc. When you use the portable enclosure you no longer have to stuff your wetsuit or any wet article into a plastic bag or bucket until you have the availability to hang them properly, you may begin the process immediately.

The portable enclosure is approximately thirty-two inches high, eighteen inches wide and nine inches deep. It is constructed of materials like pack nylon for the bag, along with nylon mesh which is used for air ventilation and doubles as a pocket on the front and sides.

The reservoir which sits in the bottom of the bag is used to capture the draining water. Crossed dividers lay in the bottom of the reservoir much like an ice cube tray to keep the wetsuit or any wet garment from laying in the water. It also keeps the water from sloshing or splashing out.

There are flaps that hang from inside the bag, all around the reservoir to direct the water that is draining down off the front, rear and side walls to over the edge of the reservoir.

The internal frame is a figure eight configuration. It is comprised of a rectangular shape with four comers, and a pole connected across the center capable of holding a hanger in place.

Connected to the internal frame are the two straps; made up of approximate one inch wide webbing, one inch wide hook and loop velcro and a buckle. At the end of one strap is the clip portion of the buckle and at the end of the other is the catch.

The hook/loop velcro combination connects at the center of the internal frame around the tee sections at the ends of the hanger pole.

The webbing portion of the straps come up through slits in the bag which allows the clip/catch of the buckle to be connected together from which you hang the bag.

The bag is then supported by the internal frame which allows it to hang in place.

In addition the bag has hook/loop velcro which attaches it to the internal frame.

A wetsuit or any article on a hanger is able to hang on the center pole of the frame. This allows the transfer of weight to go from frame directly to the straps and not to the bag itself.

There is a double pull zipper in the front of the bag for easy access.

Still another feature of the bag is a strip of material that covers the bottom of the pockets so that the water is directed back into the bag and not out.

Still another feature is that the rear portion of the bag is solid, without mesh, so that it may touch an article that you wish not to get wet. This allows the bag to lean of to favor one direction if not capable of hanging straight or perfectly vertical, plumb.

The novel features which are considered characteristic for the invention are set forth in particular in the appended claims. The invention itself, however, both as to its construction and its method of operation together with additional objects and advantages thereof, will be best understood from the following description of the specific embodiments when read in connection with the accompanying drawing.

DETAILED DESCRIPTION OF THE PREFERRED EMBODIMENT

Figure 1:
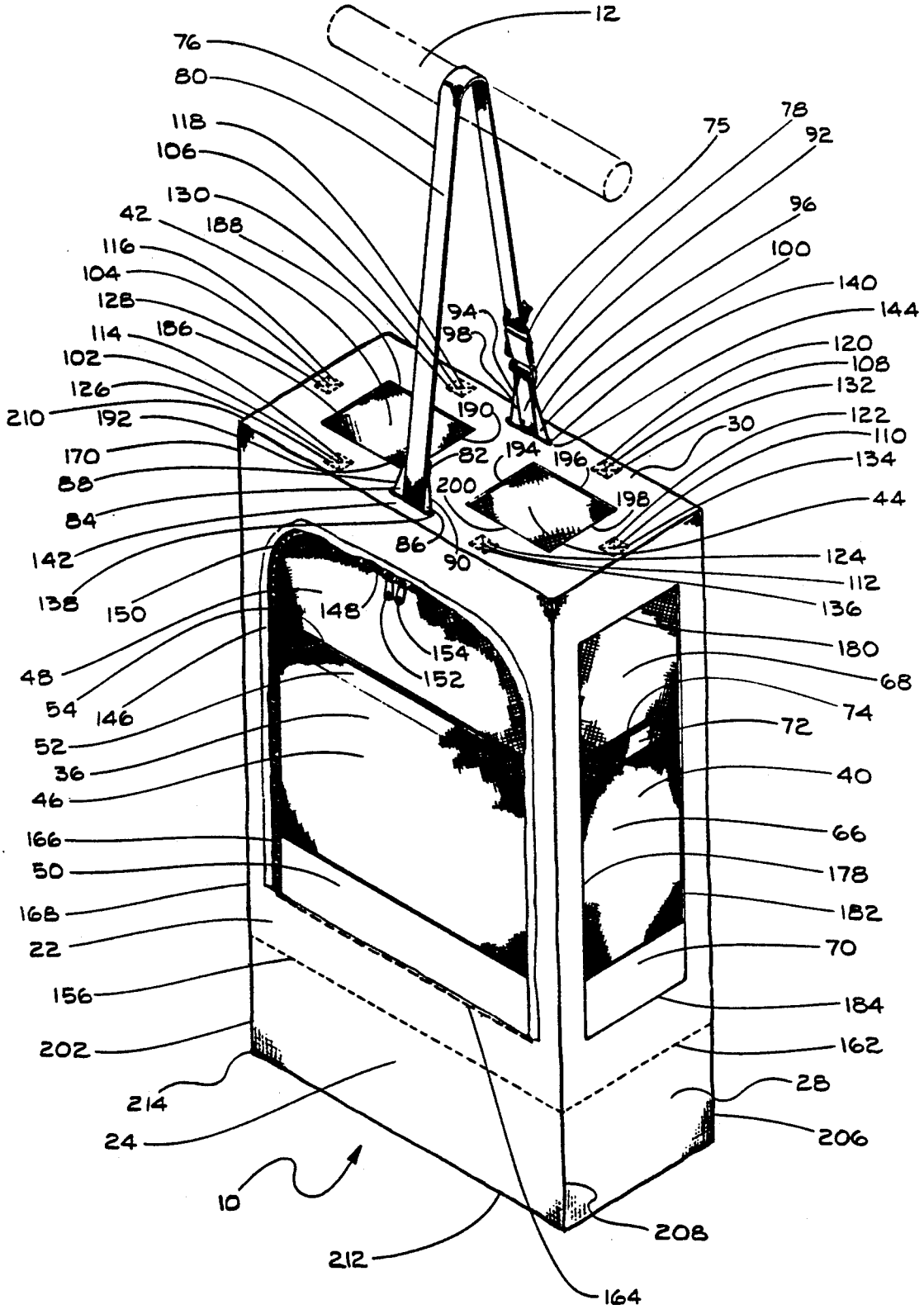
FIG. 1 shows an isometric view of the portable enclosure showing the top, front and right side. It is entirely zipped up and hanging in place.
Figure 2:
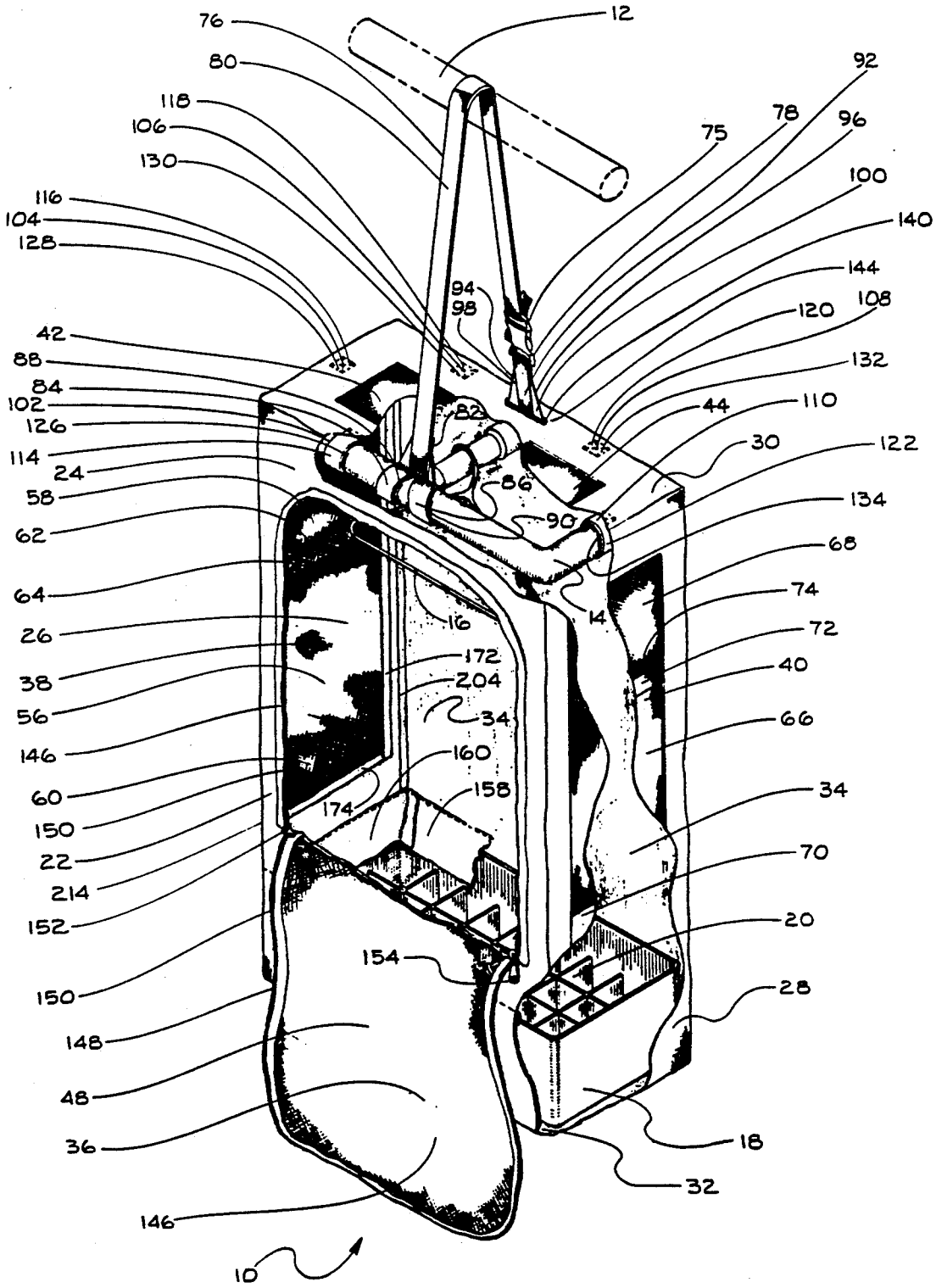
FIG. 2 shows the portable enclosure in the same view as FIG. 1 except the zipper is totally undone and along with the cutaway portion it is able to expose in addition to the top, front and right side, the left side, rear, and bottom of bag. Also shown is the internal frame, connected to the straps and the reservoir sitting in the bottom of the bag.

Referring to FIG. 1 and FIG. 2, the portable enclosure shown at 10, hanging on the pole 12. FIG. 1 shows only the outside of the portable enclosure 10. Zipped up only allows view of the bag 22 with front strap 76, and rear strap 78. In FIG. 2 the zipper is totally undone and along with the cutaway portion you are able to see the internal portions of the bag 22 including the internal frame 14 and the reservoir 18 with its rack/baffle bottom 20.

The bag 22 has six main sides or facets; the front facet 24, left facet 26, right facet 28, top facet 30, bottom facet 32 and the rear facet 36.

The front facet 24, and the zipper flap 146, connect together via the zipper assembly 148. The zipper assembly 148, is made up of the zipper chain 150, with the left zipper pull 152, and the right zipper pull 154. The front pocket 36, is connected to the zipper assembly 148, at the zipper chain 150. The front pocket 36 is also made up of the front mesh 46, and the rear mesh 48, with a cover 50, over the front mesh 46. The hook velcro 52, attaches to the front mesh 46, facing in. The loop velcro 54, attaches to the rear mesh 48, facing out.

The left pocket 38 part of the left facet 26, is made up of the front mesh 56, and the rear mesh 58, with a cover 60, over the front mesh 56. The hook velcro 62, attaches to the front mesh 56, facing in. The loop velcro 64, attaches to the rear mesh 58, facing out.

The right pocket 40, part of the right facet 28, is made up of the front mesh 66, and the rear mesh 68, with a cover 70, over the front mesh 66. The hook velcro 72, attaches to the front mesh 66, facing in. The loop velcro 74, attaches to the rear mesh 68, facing out.

The top facet 30, is made up of the left mesh 42, and the right mesh 44. Also attached to the top facet 30, is the hook/loop velcro 102, 104, 106, 108, 110 and 112 which holds the internal frame 14, in place at six locations.

The hook/loop velcro 102, is made up of the hook velcro 114, and the loop velcro 126. The hook/loop velcro 104, is made up of the hook velcro 116, and the loop velcro 128. The hook/loop velcro 106, is made up of the hook velcro 118, and the loop velcro 130. The hook/loop velcro 108, is made up of hook velcro 120, and the loop velcro 132. The hook/loop velcro 110, is made up of the hook velcro 122, and the loop velcro 134. The hook/loop velcro 112, is made up of the hook velcro 124, and the loop velcro 136. Also part of the top facet 30 is the front slit 138, with its reinforce piece 142, and the rear slit 140, with its reinforce piece 144.

The front strap 76, passes through the front slit 138, of the top facet 30 to connect to the internal frame 14, and the rear strap 78, passes through the rear slit 140, of the top facet 30 to also connect to the internal frame 14.

The buckle 75, attaches to both the front strap 76, clip portion of the buckle 75, and the rear strap 78, catch portion of the buckle 75. The front strap 76, is made up of the following items; the long webbing 80, and the short webbing 82. Sandwiched in between are two sets of velcro straps attached at the end of the webbing and forming a "Y" at the other. On the left side there is the left hook velcro 84, and the left loop velcro 88. On the right side there is the right hook velcro 86, and the right loop velcro 90. The rear strap 78, is made up of the following items; the webbing 92, folded in half and sandwiched in between are two sets of velcro straps attached at the open end of the webbing and forming a "Y" at the other. On the left side there is the left hook velcro 94, and the left loop velcro 98. On the right side there is the right hook velcro 96, and the right loop velcro 100.

There are four flaps that attach to the bag 22, just above the reservoir 18. The front reservoir flap 156, attaches to the front facet 24, and the rear reservoir flap 158, attaches to the rear facet 34. The left reservoir flap 160, attaches to the left facet 26 and it overlaps the front reservoir flap 156, over the front facet 24, and on the other end the rear reservoir flap 158, over the rear facet 34. The right reservoir flap 162, attaches to the right facet 28, and it overlaps the front reservoir flap 156, over the front facet 24, and on the other end the rear reservoir flap 158, over the rear facet 34.

The seam tape reinforcements 164 to 212 are attached to the following seams: Seam tape 164, attaches to the connection of the front pocket 36, and the front facet 24. Seam tape 166, attaches to the connection of the zipper assembly 148, and the front facet 24. Seam tapes 168, 170, 172, and 174 attach to the connection of the left pocket 38, and the left facet 26. Seam tapes 178, 180, 182, and 184 attach to the connection of the right pocket 40, and the right facet 28. Seam tapes 186, 188, 190, and 192 attach to the connection of the left mesh 42, and the top facet 30. Seam tapes 194, 196, 198, and 200 attach to the connection of the right mesh 44, and the top facet 30. Seam tape 202, attaches to the connection of the front facet 24, and the left facet 26. Seam tape 204, attaches to the connection of the left facet 26, and the rear facet 34. Seam tape 206, attaches to the connection of the right facet 28, and the rear facet 34. Seam tape 208, attaches to the connection of the front facet 24, and the right facet 28. Seam tape 210, attaches to the connection of the top facet 30, with the front facet 24, the left facet 26, the rear facet 34, and the right facet 28. Seam tape 212, attaches to the connection of the bottom facet 32, with the front facet 24, the left facet 26, the rear facet 34, and the right facet 28.

The thread 214 is used to attach all portions of the bag 22.

OPERATION OF INVENTION—FIGS. 1 AND 2

The manner of using the self contained portable enclosure 10, is as follows:

First undo buckle 75, and adjust the front strap 76. Hang portable enclosure 10, in place, by hanging strap over an object, as shown, with the pole 12. Reclip buckle 75, to rear strap 78, and adjust as needed to hang unit as vertical or plumb as possible.

Use zipper assembly 148 to undo the zipper chain 150. Utilize left zipper pull 152, and right zipper pull 154. Pull from the top out and down until the front pocket 36, is allowed to fall forward.

Check reservoir 18 to assure that it is installed properly with rack/baffle 20, in place, and that front 156, rear 158, left 160, and right 162, reservoir flaps, are in place. The flaps should hang and surround reservoirs, as shown, in FIG. 2.

Now take wet articles and place on hanger(s) 16 as needed, to be hooked over center pole of internal frame 14, as shown in FIG. 2.

As shown in FIG. 2, take left zipper pull 152, and right zipper pull 154. Pull up and in to meet at the top, to close the bag 22, as shown in FIG. 1.

Utilize front pocket 36, left pocket 38, and right pocket 40, as desired, to hold small or difficult to hang items, to drain, and dry. Pockets are opened and closed by the use of hook and loop velcro.

Wet articles should remain in portable enclosure 10, only until you are able to hang or store them properly. After articles have been removed from the enclosure 10, pull reservoir 18, out of the bag 22, and pour out liquid, wipe down inside of bag if necessary and replace reservoir for next use.

SUMMARY, RAMIFICATIONS, AND SCOPE

Accordingly the user will see that the portable enclosure has a definite advantage in being able to hang wet articles at any time or any place to expedite the draining and drying process.

Although the description above contains many specificities, these should not be construed as limiting the scope of the invention but as merely providing illustrations of some of the presently preferred embodiments of this invention. For example, the portable enclosure may be of any size, shape or material as long as it remains transportable.

Thus the scope of the invention should be determined by the appended claims and their legal equivalents, rather than by the examples given.

What is claimed as new and desired to be protected by letters patent is set forth in the appended claims:

1. A portable enclosure having an interior for placement and drying of wet articles comprising;

a rectangular frame member with a centrally positioned cross piece, said cross piece for hanging wet articles therefrom;

a housing having four sides, a top and a bottom, said housing surrounding said frame member and being supported by said frame member at said top;

support means attached to said cross piece and extending exteriorly of said housing for supporting said portable enclosure;

at least three walls and said top of said enclosure being at least partially porous for providing ventilation to the interior of said enclosure and at least one wall of said enclosure being impervious to liquid wetting from enclosed articles;

one wall of said at least three walls being opposite said impervious wall, said one wall having a closable substantially rectangular opening through an upper portion of said one wall for providing selective access to said interior of said housing;

a removable liquid reservoir positioned within said housing at said bottom thereof for collecting liquid draining from enclosed articles, said reservoir being removable from said housing through said rectangular opening, said liquid reservoir includes baffles disposed below the top edge thereof; and flexible guide means attached to the interior on said sides of said housing and extending into said reservoir for directing water draining from said articles into said reservoir.

2. The invention as defined in claim 1 wherein said rectangular frame member is constructed of rigid plastic.

3. The invention as defined in claim 1 wherein said support means is a length adjustable strap removeably attached to said rectangular frame member.

4. The invention as defined in claim 1 wherein the porous portions of said at least partially porous walls and top are constructed of plastic mesh.

5. The invention as defined in claim 1 wherein a zipper in said one wall provides selective access to the interior of said enclosure.

6. The invention as defined in claim 1 wherein said guide means is impervious to liquid.

* * * * *